United States Patent [19]

Hasegawa

[11] 4,443,006

[45] Apr. 17, 1984

[54] DOCUMENT AND CURRENCY COUNTER

[75] Inventor: Kaiichi Hasegawa, Kawasaki, Japan

[73] Assignee: Billcon Corporation of America, Compton, Calif.

[21] Appl. No.: 301,188

[22] Filed: Sep. 11, 1981

Related U.S. Application Data

[63] Continuation-in-part of Ser. No. 170,646, Jul. 21, 1980, abandoned.

[51] Int. Cl.[3] ..... B65H 3/06

[52] U.S. Cl. ..... 271/10; 271/119; 271/124; 271/165

[58] Field of Search ..... 271/10, 119, 120, 121, 271/124, 125, 165, 166

[56] References Cited

U.S. PATENT DOCUMENTS

| | | | |
|---|---|---|---|
| 1,061,585 | 5/1913 | Armstrong | 271/119 |
| 1,919,238 | 7/1933 | McCarthy | 271/119 |
| 2,764,409 | 9/1956 | LaBombard | 271/120 X |
| 3,506,258 | 4/1970 | Lindquist | 271/119 |

*Primary Examiner*—Richard A. Schacher
*Attorney, Agent, or Firm*—Bruce L. Birchard

[57] ABSTRACT

An improved counter for documents, currency, paper money, sheets or the like achieves low weight, low power consumption, low cost and high counting accuracy by a feeding mechanism in which a first roller or set of rollers successively feeds a sheet from the bottom of a stack thereof to a second roller or set of rollers for further feeding, on a sheet-by-sheet basis, to a pair of pulling rollers which pulls each sheet at high speed and dispenses it. The first and second rollers or sets of rollers have about their respective peripheries portions having a large coefficient of friction and portions having a small coefficient of friction. Such intermittent feed rollers are synchronized to rotate with related space phases, i.e. with the low friction coefficient portion of each roller in contact with its associated sheet at the same time, thus assuring that the pulling rollers require minimal torque to pull each sheet away from the second of the intermittent rollers. Smooth, low friction flanges on each roller over an arc of length and location equivalent to said portions of small coefficient of friction on each roller assure no retention of a document, even though badly creased, after the pulling rollers take over the document.

8 Claims, 7 Drawing Figures

DOCUMENT AND CURRENCY COUNTER

RELEVANT CO-PENDING APPLICATION

This application is a continuation in part of U.S. patent application Ser. No. 170,646 filed July 21, 1980 by the present inventor and entitled IMPROVED DOCUMENT AND CURRENCY COUNTER and now abandoned.

BACKGROUND OF THE INVENTION

1. Field of the Invention

This invention relates to sheet-by-sheet document and currency counters.

2. Prior Art

In general, in a sheet processing machine, such as a currency counter, a sheet feeding device is ordinarily provided for successively paying out or feeding, one-by-one, a large number of sheets in a stacked state to the sheet processing, or counting section of the machine.

In prior art document and currency counters, a feed-in roller was disposed below the sheet stack and contacted the lowermost sheet. As the feed-in roller rotated it fed the lowermost sheet to a paying-out roller, which, in cooperation with a guide plate and a feed roller further fed the sheet toward a pair of pulling rollers, which pulled each sheet at a speed which was two to three times the speed at which the sheet traveled past the paying-out and feed rollers.

In the prior art sheet feeding devices, the pulling rollers exerted a tension on each sheet since the sheet was not fully clear of the paying-out and feed rollers when the pulling rollers started to pull the sheet at high speed. Consequently, an undesirable torque load was placed upon the motive power means, such as the drive motor, which must therefore have had an output capacity to handle this additional load.

Therefore, it is a general object of this invention to provide an improved document and currency counter.

It is a further object to provide a document and currency counter with a sheet feeding device which imposes a minimal torque load on the motive power means.

It is an additional object of this invention to provide a low-cost document and currency counter with minimal electrical power consumption.

SUMMARY OF THE INVENTION

According to this invention, briefly summarized, there is provided in a counter for documents, currency, or like sheets, such counter including a first roller or set of rollers for feeding, successively, sheets from the bottom of a stack of said sheets, a second roller or set of rollers for receiving and further feeding out each sheet from said first roller, or set of rollers, a guide plate for guiding each sheet around a part of the cylindrical surface of the second roller, or set of rollers and pulling rollers for grasping each sheet and pulling the same at high speed from the second roller, the cylindrical surface of each of the first roller and the second roller having a first portion of large coefficient of friction and a second portion of small coefficient of friction, said two rollers being synchronized to rotate with a fixed space phase so that when the pulling rollers engage a sheet, that sheet will be in contact with the portions of either or both of said first and second rollers having low coefficients of friction. To prevent double feeding of creased bills, low friction flanges are provided on each side of each roller in the second set.

BRIEF DESCRIPTION OF THE DRAWINGS

The nature, utility, and further features of this invention will be more clearly apparent from the following detailed description when read in conjunction with the accompanying drawings, in which.

DETAILED DESCRIPTION OF THE PREFERRED EMBODIMENT

Figure 1:
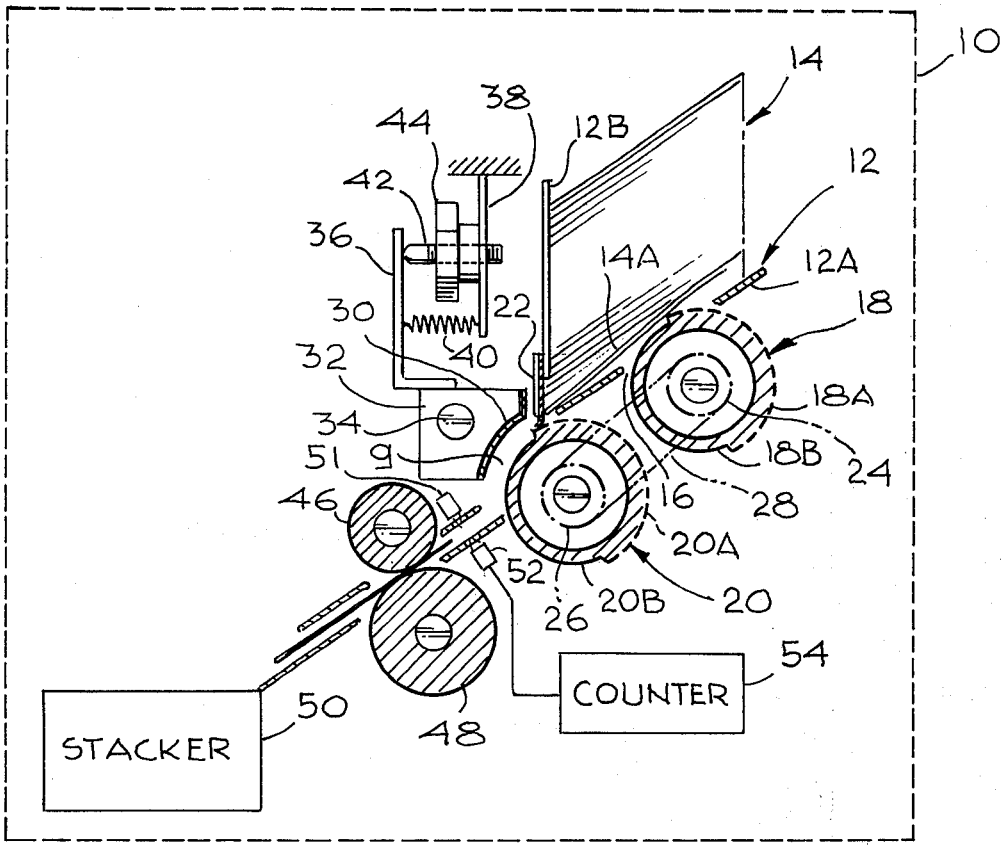
FIG. 1 is a side-elevation view partially schematic in nature, and partially cross-sectional, showing one embodiment of the sheet feeding mechanism in a counter according to this invention.

In FIG. 1, counter 10 has a feed tray or hopper 12, in which sheets 14 are stacked. The inclined floor plate 12*a* is provided with a transverse slot 16 through which the upper part of a feed-in roller 18 projects upward to a position where it can contact the lowermost sheet 14*a* of the stack. The feed-in or jogging roller 18 is for feeding in the sheets separately and successively toward a slot-like feed-in opening formed between the lower edge of the vertical wall plate 12*b* of the hopper 12 and the upper part of a delivery roller 20. A transverse rubber auxiliary plate 22 fixed at its upper edge to the lower edge of the vertical wall plate 12*b* extends downwardly and is in contact with the cylindrical surface of the delivery roller 20. This auxiliary plate 22 functions to facilitate the action of peeling the sheets 14, one-by-one, away from the bottom of the stack.

The feed-in roller 18 and the delivery roller 20 may have the same diameter, as is shown in FIG. 1. Sectors of the cylindrical peripheral surfaces of these rollers 18 and 20 have serrated or ribbed surfaces 18*a* and 20*a* of relatively large radius and with high frictional coefficient provided by the material of surfaces 18*a* and 20*a*, e.g. rubber, and by the ribs extending parallelly to the roller axes. The remaining sectors of these rollers 18 and 20 are smooth, low-friction-coefficient surfaces 18*b* and 20*b*, one which may be of metal or plastic, and may have a smaller radius than portions 18*a* and 20*a*, respectively. The feed-in roller 18 and the delivery roller 20 are caused to rotate synchronously by a timing mechanism comprising timing pulleys 24 and 26 respectively fixed to their axes and an endless timing belt 28 stretched around pulleys 24 and 26. Feed-in roller 18 may be advanced in space phase with respect to delivery roller 28.

A guide member 30 which is of arcuate cross section and which may be of rubber is supported by support member 32 so that the concave surface of the guide member 30 is juxtaposed to the cylindrical surface of the delivery roller 20 with clearance therebetween in the vicinity of and downstream (i.e., in the direction of travel of the sheets) from the auxiliary plate 22, as shown in FIG. 1. The support member 32 is pivotally supported at a pivot 34, and therefore the guide member 30 is adjustable, rotatably, about the pivot 34.

The gap "g" between the guide member 30 and the hemi-cylindrical surface 20*a* of the delivery roller 20 is made sufficient for sliding passage therethrough of a single sheet 14 while assuring that hemi-cylindrical surface 20*a* contacts each successive sheet 14 with sufficient pressure to deliver the sheet by frictional force. The gap "G" between the guide member 15 and the hemi-cylindrical surface 20*b* of relatively small radius is large, being of the order of several tens of times the thickness of each sheet 14, thereby permitting free and unimpeded passage of each sheet 14.

The angular position of the guide member 30 and its support member 32 is adjusted and set by any suitable mechanism, one example of which is illustrated in FIG. 1. In FIG. 1, the adjustment mechanism comprises an L-shaped member 36 fixed to the support member 34, a support plate 38 rigidly fixed to a base member, not shown, and a tension spring 40 supported between the member 36 and the support plate 38 and thereby continually urging the member 36 to move toward the support plate 38, that is, to rotate clockwise (as viewed in FIG. 1) about the pivot 34, an adjusting screw 42 passed through and supported by the support plate 38 and having an end abutting against the member 36 thereby to set the angular position thereof, and a nut 44 with a calibration dial engaging the threads of adjusting screw 42. Thus, by manipulating the nut 44, the adjusting screw 42 is caused to advance or retract thereby to adjust the gap "g" between the guide plate 30 and the hemicylindrical surface 20*a* of the delivery roller 20.

On the outlet or downstream side of the delivery roller 20, there is provided a pair of upper and lower tension rollers 46 and 48 with cylindrical surfaces made of a material of high frictional coefficient. The upper tension roller 46 is continually pressed toward the lower tension roller 48 by springs (not shown). These rollers 46 and 48 are driven to rotate at a circumferential speed which is two to three times that of the delivery roller 20 and operate to grasp each sheet 14 delivered by roller 20 and to convey each such sheet at high speed to the succeeding processor, for example stacker 50.

While, in the present description, each of the various rollers, for example, the feed-in or jogging roller 18 and the delivery roller 20, are referred to in the singular, it is to be understood that each roller may be segmented, i.e., it may comprise a plurality of rollers mounted in spaced-apart positions on a single rotational shaft, as is the common practice.

The sheet feeding device according to this invention operates in the following manner, referring to FIGS. 1 to 4.

Figure 2:
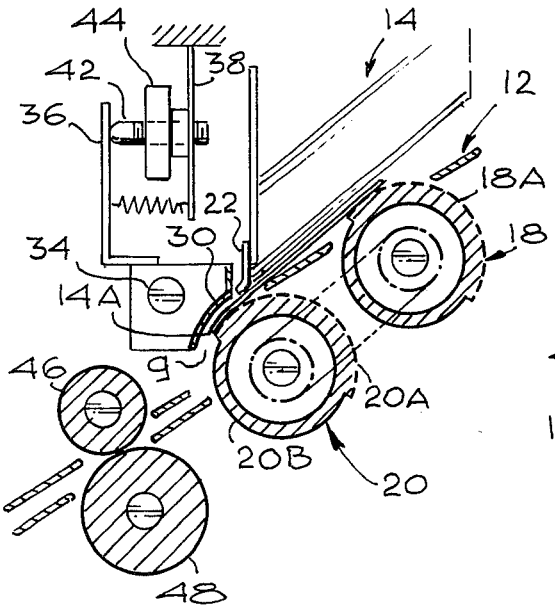
FIGS. 2, 3 and 4 are side elevation views similar to FIG. 1 showing progressive states of operation of the same device; and, FIG. 5 is a graph showing curves respectively indicating the torques required of a motor for driving prior art sheet feeders and sheet feeders of this invention.

When the delivery roller 20 and the feed-in roller 18 are driven by belt 28, and the surface 18*a* of relatively large radius of the feed-in roller 18 contacts the lowermost sheet 14*a* of the sheets 14 stacked in the hopper 12, sheet 14*a* begins to enter the gap "g" between the delivery roller 20 and the guide plate 30 as indicated in FIG. 2. At this time, the driving motor (not shown) is required to exert a torque $T_1$.

Figure 3:
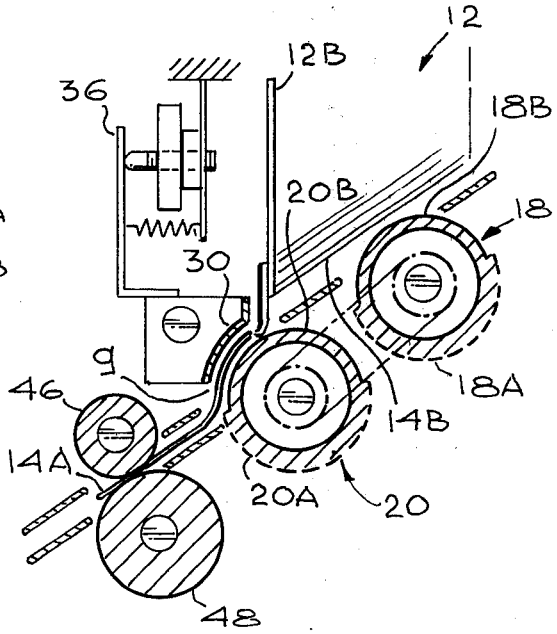

Then, as the delivery roller 20 rotates further, and the leading edge of the sheet 14*a* is acquired by and is drawn between tension rollers 46 and 48, the sheet 14*a* is pulled at two to three times its original speed, as is indicated in FIG. 3. At this time, the trailing edge of sheet 14*a* is still between the delivery roller 20 and the guide member 30, but by this time, the smooth hemicylindrical surface 20*b*, which may be of small radius, is facing this trailing edge, which is now in the aforedescribed large gap "G". For this reason, the torque required of the pulling rolls 46 and 48 is very small, being of an order just sufficient to convey the sheet 14*a*. At this time, furthermore, the succeeding sheet 14*b* at the bottom of the stack in the hopper 12 is contacting the smooth surface 18*b* of relatively small diameter of the feed-in roller 18 and is therefore at rest and is not fed toward the guide plate 30.

Figure 4:
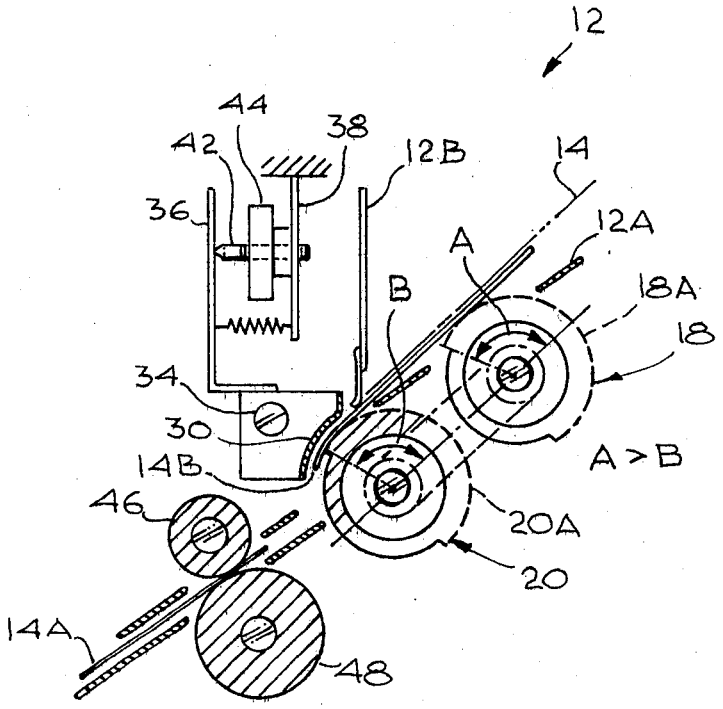

Then, as the feed-in roller 18 and the delivery roller 20 rotate further, and the surfaces 18*a* and 20*a* of greater radius face and contact the sheet 14*b*, the sheet 14*b* is moved toward the guide plate 40 as indicated in FIG. 4, and thereafter the aforedescribed operation is repeated for each sheet 14.

For optimum performance of counter 10, the circumferential length of driving portion 20*a* of roller 20 should be at least as long as the dimension "l" of sheet 14 in the direction of its travel through counter 10. Thus, a single revolution of roller 20 will move each sheet 14 past guide member 30 into a state of acquisition by tension rollers 46, 48, if the tension rollers are spaced properly with respect to delivery roller 20. That spacing, namely the spacing between the contact line between rollers 46 and 48, and the nearest driving point on the circumference of drive roller 20 (i.e. edge 31 of guide member 30) should be slightly less than the dimension, "l", of each sheet 14 in the direction of its travel.

If the circumferential length of portion 20*a* is less than the dimension of a sheet 14 in the direction of its travel, several revolutions of roller 20 may be required to deliver a sheet 14. Because rollers 18 and 20 are synchronized, roller 18 will also rotate several times and may feed a second sheet 14 into delivery roller 20, causing a jamming of counter 10, or a miscount, or both.

Counting of sheets 14 occurs at their discharge from drive roller 20 and is achieved by means of a light source 51 (which may be an LED) illuminating a photoelectric device 52, which feeds a pulse to counter 54. Device 52 may be a photo-diode. Counter 54 may be any one of several pulse counters which are commercially available and need not be described here.

Figure 5:
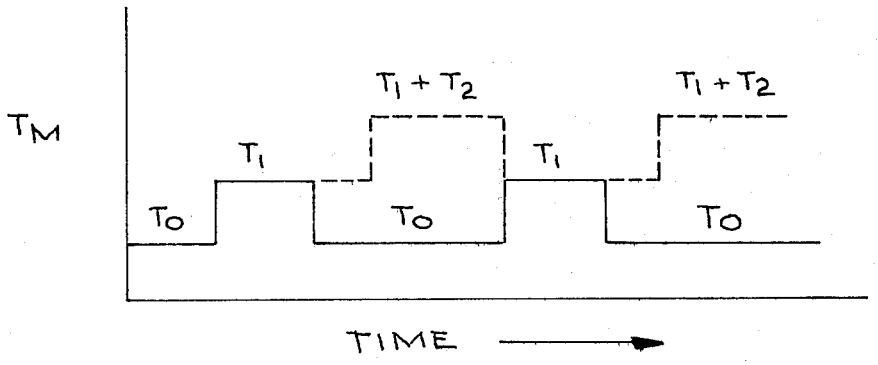

In the foregoing operation and referring to FIG. 5, of the torque load $T_M$ imparted to the driving motor (not shown) for driving all of the rollers, the torque $T_1$ mentioned hereinbefore and indicated in FIG. 5 is the predominant torque. Moreover, this torque $T_1$ is imparted intermittently. Thus, a torque which is less than that required in prior art devices, that prior art device torque being indicated by the broken line in FIG. 5, is sufficient to operate the device of this invention.

At the same time, this also means that, for the same rotational speed of the motor, the required power output of the motor in the device of this invention is less than for prior art counters in substantially direct proportion to the torque reduction, since power is directly proportional to the product of the torque and the rotational speed. For the same reason, the graphical representation in FIG. 5 may be considered to be that of power. Then, since the product of power and time is expended energy, the area between the two curves may be interpreted as the difference in energies respectively consumed by prior art counters and the counters of this invention. These features afford the advantageous use of a smaller, less expensive motor.

While the cylindrical surfaces 18*a* and 20*a* of the feed-in roller 18 and the delivery roller 20 have been described as having ribs or ridges extending parallelly to the roller axes for the purposes of increasing the coefficient of friction of these surfaces, other surface materials and states such as rubber with concavities and convexities, planar rubber, or sponge-line rubber can be used. As for the smooth surfaces 18*b* and 20*b*, no particular description has been given, but these surfaces are preferably made of a metal or a synthetic resin.

While a difference in radii of portions 18*a* and 18*b* and 20*a* and 20*b*, respectively, have been described, the basic requirement is that the "A" portions have a high coefficient of friction and the "B" portions have a low coefficient of friction. The radii may be equal. However, for absolute assurance of such difference in coefficients of friction the difference in radii may be provided.

Another possible modification is that of the ratio between the lengths of the arcs, as viewed in cross-section, of the surfaces 18*a* and 18*b* and surfaces 20*a* and 20*b*. In the above described example, this ratio is 1:1, but it may be changed to suit the dimension of each sheet 14 in the direction of its travel.

A further example of possible modification concerns the manner in which the guide member 30 is adjustably supported. While in FIGS. 1 thru 4 this guide member 30 is fixed to a support member 32 pivotally supported on a pivot 34 and is therefore adjustable by a rocking movement, it may be adapted to move translationally for adjustment of the gap between it and the delivery roller 20.

Figure 6:
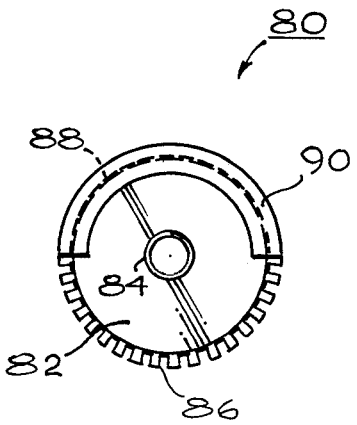
FIGS. 6 and 7 show side and edge views, respectively, of one configuration for the second rollers.
Figure 7:
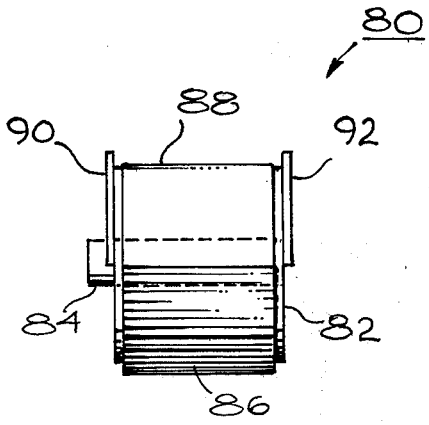

A roller configuration which assures document feeding on a sheet-by-sheet basis, even though that document or those documents may be creased, is shown in FIGS. 6 and 7. In FIGS. 6 and 7, roller 80 has a body portion 82 with a hollow shaft-receiving shoulder 84, therein, for receiving a driving shaft, not shown. Body portion 82 may be of plastic material. Ribbed or serrated material 86, which may be of high-friction-coefficient material, such as synthetic rubber, covers a sector of the cylindrical surface of body portion 82. In FIG. 6 the sector is shown to be 180°, but other sector lengths may be used. The remaining sector 88 of the cylindrical portion of body 82 does not bear the ribbed or serrated material 86 and is, thus, of smaller diameter than portion 86. It may bear a thin layer of material merely for supporting portion 86 on roller body 82. On the other hand, portion 88 may be bare. In any event, it shows low friction effects relative to portion 86. However, experience has shown that it is commonplace for people to fold and crease documents, particularly currency. When that occurs, double-feeding may occur, a phenomenon that results in mis-counts. I have found that by adding low-friction flanges 90 and 92, having a sector length approximately that of portion 88, double-feeding due to creasing is avoided.

While particular embodiments have been shown and described it will be apparent to those skilled in the art that variations may be made in those embodiments without detracting from the spirit and scope of this invention. It is the intention of the appended claims to cover all such variations.

What is claimed is:

1. A sheet counter or the like including:

means for holding a stack of sheets of dimension "1" in the direction of feeding thereof through said counter;

a feed-in roller rotatably supported for contacting the bottom sheet in said stack of sheets to feed such sheet from said stack;

a delivery roller rotatably supported in spaced relationship with respect to said feed-in roller for receiving each sheet fed from said stack;

a guide member supported in juxtaposed but spaced alignment with said delivery roller for guiding each sheet around the cylindrical surface of said delivery roller, said guide member having an output edge;

tension rollers having a contact line therebetween and being positioned by a dimension less than "1" from said guide member with their axes parallel to the axis of said delivery roller for receiving and feeding forward at relatively high speed each sheet emerging from the space between said guide member and said delivery roller;

said delivery roller having a surface with a first portion having a high coefficient of friction and a second portion of a low coefficient of friction;

said feed-in roller also including a first portion having a high coefficient of friction and a second portion having a low coefficient of friction;

said delivery roller having a flange movable in concert therewith, said flange having a radius substantially equal to the radius of said first portion and having a length equal to that of said second portion of said delivery roller and being positioned contiguous therewith.

2. Apparatus according to claim 1 in which said feed-in roller and said delivery roller are intercoupled by a belt and rotate synchronously with the feed-in roller having advanced space-phase with respect to said delivery roller.

3. Apparatus according to claim 1 in which said first portion of said feed-in roller and said first portion of said delivery roller have larger radii of curvature than the respective second portions.

4. Apparatus according to claim 1 in which each of said first portions is serrated.

5. Apparatus according to claim 1 in which said first portion of said delivery roller has a length substantially equal to the dimension of each sheet in the direction of its travel past said guide member.

6. Apparatus according to claim 1 in which the radius of said flange exceeds the radius of said second portion.

7. Apparatus according to claim 1 in which said delivery roller has first and second flanges on first and second sides, respectively, of said delivery roller and integral therewith, the radius of each of said flanges being substantially equal to the radius of said first portion and the length of said flanges being substantially equal to the length of said second portion.

8. Apparatus according to claim 1 in which said first portion of said delivery roller exceeds the length of said first portion of said feed-in roller.

* * * * *